United States Patent [19]

Rascov

[11] Patent Number: 4,671,381

[45] Date of Patent: Jun. 9, 1987

[54] LINEAR MUFFLER SHOCKWAVE SUPPRESSOR

[76] Inventor: Anthony J. Rascov, 4303 Robasco Rd., Cincinnati, Ohio 45244

[21] Appl. No.: 831,477

[22] Filed: Feb. 20, 1986

[51] Int. Cl.[4] ..... F01N 1/08

[52] U.S. Cl. ..... 181/255; 181/264; 181/269; 181/282

[58] Field of Search ..... 181/247–249, 181/269, 270, 275, 279, 281, 265, 268, 255, 282

[56] References Cited

U.S. PATENT DOCUMENTS

| | | | |
|---|---|---|---|
| 2,009,343 | 7/1935 | Peik | 181/265 X |
| 2,121,242 | 6/1938 | Barron | 181/265 |
| 2,484,521 | 10/1949 | May | 181/265 |
| 2,484,827 | 10/1949 | Harley | 181/268 |
| 2,902,109 | 9/1959 | Burgess et al. | 181/265 |
| 3,100,140 | 8/1963 | Ashley et al. | 181/268 X |

*Primary Examiner*—Benjamin R. Fuller
*Attorney, Agent, or Firm*—Frost & Jacobs

[57] ABSTRACT

A muffler capable of suppressing the shockwave generated by an internal combustion engine forming a housing having an inlet and an outlet and a center rectifier section extending between the inlet and the outlet, the center rectifier section having a transverse cross-sectional area substantially the same as or greater than the transverse cross-sectional area of either the inlet or the outlet, and having a small dimension and a large dimension, the large dimension being several magnitudes of order greater than the small dimension.

13 Claims, 7 Drawing Figures

LINEAR MUFFLER SHOCKWAVE SUPPRESSOR

BACKGROUND OF THE INVENTION

1. Field of the Invention

The present invention concerns a muffler for an internal combustion engine. In particular, the present invention concerns a linear muffler designed to be mounted in the exhaust system of an automobile to suppress the shockwaves in the exhaust system.

2. Prior Art

Virtually all internal combustion engines, whether for a lawnmower or for an automobile, require a muffler to suppress the shockwaves caused by exhausting the spent fuel-air mixture from the chamber of each reciprocating piston. Conventional design of an exhaust system includes an exhaust pipe which is directly coupled to each piston chamber and which in turn is coupled to a muffler.

Conventional exhaust pipes are cylindrical in design because it is the most economical shape with respect to material usage per internal volume. For this reason, exhaust pipes have uniformly been circular in cross-section and will presumably continue to be so. However, the cylindrical cross- sectional shape of an exhaust pipe does not aid in significantly suppressing the plurality of shockwaves generated by the internal combustion engine. In fact, shock waves generally travel in a conical shape and the cylindrical cross-section of an exhaust pipe does not suppress the shockwave. This is easily evidenced by the fact that the resultant sound of a disconnected muffler is significantly louder than with a connected muffler.

Conventional muffler design has merely been to increase the cross-sectional area of the exhaust system emerging from the cylindrical cross-section of the exhaust pipe, thus greatly reducing the speed which the shockwave travels through the muffler. Additionally, the muffler includes a plurality of baffles generally consisting of partially extending walls across the interior of a conventional muffler to break up the shockwaves, thereby reducing the noise level. Typically, the conventional muffler is circular in shape, like the exhaust pipe, or it may sometimes be oval in shape. While these exhaust pipes are minimally acceptable for reducing the shockwave and thereby reducing the resultant sound, these mufflers are expensive to manufacture due to the plurality of partial walls within the muffler and due to the material requirements and necessary labor intensive manufacturing steps.

Accordingly, one of the chief aims of the present invention is to produce a muffler which is capable of being formed with a reduced number of manufacturing steps.

Another aspect of the present invention is to construct a simpler muffler than conventional types which is capable of significantly reducing the shockwaves and the resulting sound.

Another aim of the present invention is to provide a new shape for a muffler which can easily be adapted to conventional exhaust systems of present day automobiles.

Another aim of the present invention is to provide a muffler having a shape that reduces the size of or omits the necessity for a cavity in the underside of an automobile for the muffler.

Another aspect of the present invention is to significantly reduce the shockwaves emitting from an internal combustion engine at least as well as or better than conventional mufflers, while employing less material usage in manufacturing the muffler as compared to conventional mufflers.

SUMMARY OF THE INVENTION

All of the aims and aspects discussed previously are achieved with the muffler of the present invention which is significantly linear in shape. The muffler of the present invention can be stamped out from common sheet metal in two pieces, including the exhaust inlet and outlet and the two pieces can be welded to one another along their common peripheral edges.

The muffler includes a circular inlet port which is quickly transformed in shape to a thin linear cross-section. The linear cross-section greatly suppresses the conical shockwaves such that the use of interior partial extending walls or other baffles is unnecessary. Optionally, the interior of the muffler could be provided with a corrugated support wall which would be in line with the exhaust gas flow so as to minimally disrupt the flow through the muffler. The corrugated wall increases the boundary layer air friction, thereby reducing the shockwave in the exhaust flow.

The present invention comprises a muffler having an inlet portion, a middle portion, and an exhaust portion. The middle portion is formed by closely spacing two parallel plates from one another so as to present a long thin linear cross- section to the gases flowing through the muffler. Both the inlet portion and the exhaust portion include transition members which extend from the middle portion to a circular cylindrical component designed to receive conventional components of an exhaust system.

In the broadest sense, the muffler of the present invention includes a housing having an inlet, an outlet, and a center section, the center section having a substantially interior surface area with a transverse cross-section having a small dimension and a large dimension several magnitudes of order greater than the small dimension.

BRIEF DESCRIPTION OF THE DRAWINGS

Further features and characteristics of the present invention can be obtained by referencing the description of the invention along with the accompanying drawings, in which.

DESCRIPTION OF THE PREFERRED EMBODIMENTS

Figure 3:
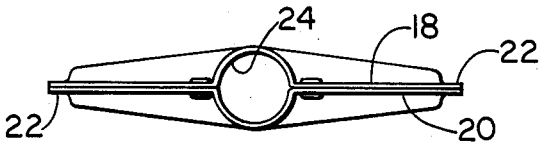
FIG. 3 is a front view of the muffler of the present invention taken along line 3—3 of FIG. 1.
Figure 1:
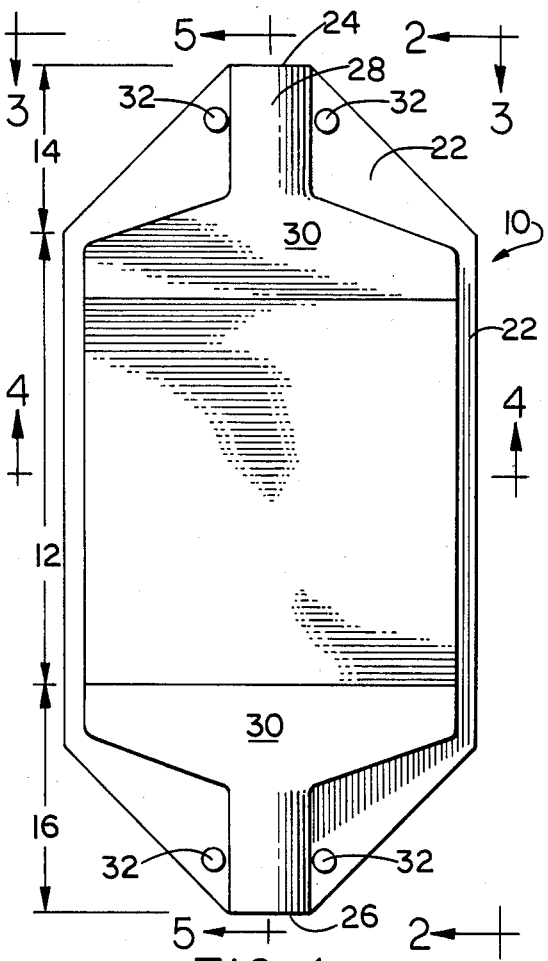
FIG. 1 is a plan view of the linear muffler of the present invention.

Now turning to FIG. 1, there is illustrated the muffler of the present invention generally indicated by reference numeral 10. The muffler may be made from any conventional material, such as metal. Preferably, the muffler is made from steel plate which has been treated to resist rusting, such as a galvanizing treatment.

As illustrated in FIG. 1, the muffler includes a middle portion or rectifier 12, an inlet portion 14 and an exhaust portion 16.

Figure 2:
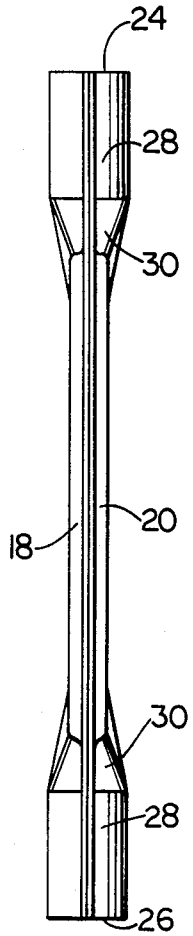
FIG. 2 is a side edge view of the muffler of the present invention taken along line 2—2 of FIG. 1.
Figure 5:
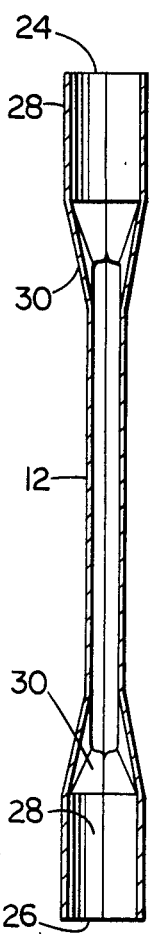
FIG. 5 is another embodiment of the present invention shown as a cross-sectional view through the mid portion of the embodiment.

As evidenced from viewing FIGS. 1, 2 and 5, the inlet portion 14 and the exhaust portion 16 are similar and symmetrically shaped with respect to a longitudinal center line. Although the inlet and exhaust outlet are in straight alignment with one another, an optional feature of the present invention would be to offset the inlet from the outlet. Since the inlet portion 14 is substantially similar to the exhaust portion 16, it will only be necessary to discuss the inlet portion 14, realizing that the exhaust portion 16 is the same.

In viewing FIGS. 2, 3, 4 and 6, it is apparent that the muffler 10 is made of a first member 18 and a mirror image second member 20. Each member includes a mating peripheral edge 22 which extends from the circular cross-sectional opening 24 to the circular cross-sectional exhaust outlet 26. The circular cross-sectional inlet 24 is formed by mating the peripheral edge 22 of the first and second members, each having a semicylindrical channel 28.

When the first and second members 18,20 are secured to one another by welding or the like, the cylindrical inlet 24 and the exhaust outlet 26 taper toward one another in a transition area 30. The transition area 30 extends from each semicylindrical channel 28 to the middle portion or rectifier 12 of the muffler 10. Additionally, the transition area 30 greatly increases in width from the diameter of the inlet 24 to a width, typically several magnitudes of order greater. Also, the height tapers from the cylindrical inlet 24 which has a large diameter or height, to a small height of the middle portion or rectifier 12 which is several magnitudes of order smaller.

Figure 4:
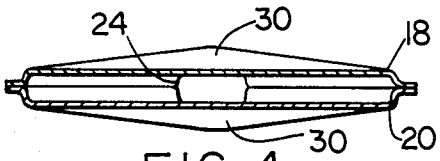
FIG. 4 illustrates a cross-sectional view through the mid portion of the muffler of the present invention; taken along line 4—4 of FIG. 1.

The middle portion or rectifier 12 of the muffler is uniformly shaped, having a small height and a large width, as shown in FIG. 4. Thus, the transition area 30 tapers from the height of the cylindrical inlet 24 to the small height of the middle portion of the muffler and expands in width from the diameter of the inlet 24 to the large width of the middle portion 12.

In order to demonstrate a typical size of a muffler for an internal combustion engine, but without limiting the invention to the size as set forth, the inlet 24 and the exhaust outlet 26 may be about three inches in diameter for an automobile internal combustion engine. The cross-section area for a three-inch diameter inlet is: $A=r^2=3.14\times(1.5)^2$ which equals about 7 square inches. The cross-sectional area of the middle portion or rectifier 12 is typically one-half inch in height and at least 14 inches in width such that the cross-sectional area is at least 7 square inches. Although the cross-sectional area of the exhaust system, including the muffler, is not significantly increased, unlike conventional systems, changing the shape of the muffler from a cylindrical shape to a flat planar linear shape of the middle portion 12 presents a significant increase in interior surface area of the muffler in contact with the exhaust gases. In other words, the middle section has an interior surface area of at least one magnitude of order greater than an equivalent length of the inlet or the outlet and the middle section has a transverse cross-sectional area the same as or greater than the transverse cross-sectional area of either the inlet or outlet.

Unlike the typical cylindrical muffler which permits the conical shaped shockwaves to be transmitted along the exhaust system, the flat, planar muffler of the present invention baffles the conical shockwaves and presents significant surface area exposure to the shockwaves so as to increase boundary layer drag of the shockwaves, thereby baffling and reducing the shockwave to a uniform output. This output may then be exhausted through a cylindrical pipe in the conventional manner. Of course, the exhaust outlet could remain flat and somewhat planar in shape, if the exhausted gases do not require further transportation to the rear or side of the automobile.

As illustrated in FIG. 1, two pair of holes 32 are provided at the inlet 24 and adjacent the exhaust outlet 26 to permit the use of the conventional U-shaped clamp to tighten the muffler to the exhaust pipe in the conventional manner.

Optionally, it may be desired to increase the interior surface area of the flat planar middle portion 12 and perhaps the transition area 30 by corrugating or dimpling the first and second members 18,20. By increasing the surface area of the middle portion 12 of the muffler 10, additional boundary layer drag effects the shockwaves and acts to further reduce or suppress the shockwaves, as discussed previously.

Figure 6:
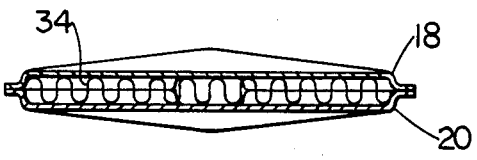
FIG. 6 is a cross-sectional view through the mid-portion of the muffler of another embodiment of the present invention.

Because the muffler 10 of the present invention has a small height, for example, one-half inch, the interior of the middle portion 12 may optionally be strengthened to prevent a rock or stone from flying up and significantly denting the middle portion 12 of the muffler 10, thereby substantially decreasing the cross-sectional area. In order to make the middle portion stronger, a corrugated metal strip 34 fills substantially the entire cross-section of the middle portion and each apex may be secured to the first or second member 18,20 by adhesives or welding or the like, as illustrated in FIG. 6. The continuous strip 34 is oriented so that it presents its leading and trailing edge transverse to the air flowing from the inlet 24 to the exhaust outlet 26, thereby occupying very little of the cross-sectional area of the middle portion 12. However, the corrugated strip 34 greatly increases the strength of the first and second members 18,20 to enable them to resist rock and stones which may impact their exterior surface. The corrugated strip also increases the boundary layer because it increases the surface area contacted by the exhausted gas. Thus, the corrugated strip assists in rectifying the shockwave.

Figure 7:
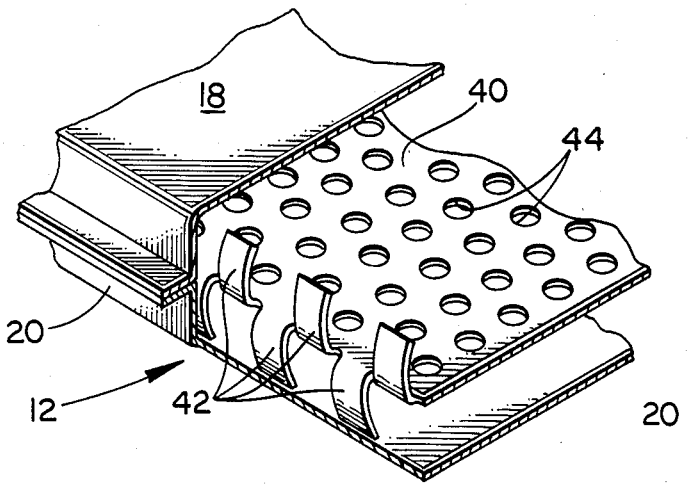
FIG. 7 is a perspective view of another embodiment of the present invention showing a dual center section.

In an alternative embodiment, illustrated in FIG. 7, the muffler can be manufactured with a dual layer rectifier section 12, thus permitting the muffler to be smaller in width or length. As illustrated in FIG. 7, the rectifier 12 is twice as high as the rectifier 12 shown in FIG. 4, for example. Positioned within the rectifier 12 is a planar plate 40, in parallel with the flat surfaces of the first and second members 18,20. The lateral edges of the plate 40 are initially formed with a plurality of slits producing a plurality of fingers 42. Alternately, the fingers 42 are bent downwardly and upwardly, as illustrated in FIG. 7.

Additionally, a multitude of small holes 44 are formed in plate 40 to increase the boundary layer surface area in contact with exhaust gases. The plate 40 is positioned between the first and second members 18,20, during manufacturing. The fingers 42 prevent the first and second members from mating with one another, i.e., the finger 42 holds the members apart from one another. Pressure is applied to the first and second members 18,20 causing the fingers 42 to resiliently yield, permitting the first and second members to mate with one another. While the pressure is being maintained, the members are secured to one another, such as by welding. Because the fingers 42 will forever remain under pressure, and because of their resilient nature, the plate 40 will remain fixed in position without the necessity for welding or otherwise further securing it to the muffler.

While the invention was described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims. For example, plate 40 in FIG. 7 could include a plurality of dimples or corrugations in addition to holes 44, or in place of holes 44 in increase the boundary layer surface area.

What is claim is:

1. A muffler for use with an internal combustion engine, comprising:

(a) a housing having an inlet, an outlet, and a center rectifier section;

(b) a transitional section between said inlet and said center rectifier section and between said outlet and said center rectifier section;

(c) said inlet and said outlet each having known transverse cross-sectional areas, wherein each has a known height and a known width;

(d) said center rectifier section having a transverse cross-sectional area at least equal to said transverse cross-sectional area of one of said inlet and said outlet, wherein the height of said center rectifier section is substantially smaller than said known height of said inlet and substantially smaller than said known height of said outlet and the width of said center rectifier section is substantially larger than said known width of said inlet and substantially larger than said known width of said outlet;

(e) said transitional section between said inlet and said center rectifier section having a height which decreases uniformly from said known height of said inlet to said substantially smaller height of said center rectifier section and a width which increases uniformly from said known width of said inlet to said substantially larger width of said center rectifier section; and, (f) said transitional area between said center rectifier section and said outlet having a height which increases uniformly from said substantially smaller height of said center recitifer section to said known height of said outlet and a width which decreases uniformly from said substantially larger width of said center rectifier section to said known width of said outlet.

2. The muffler of claim 1, wherein said inlet and said outlet have a circular cross-sectional shape.

3. The muffler of claim 1, wherein said center rectifier section includes a corrugated strip extending transversely across said center rectifier section and secured thereto.

4. The muffler of claim 3, wherein said corrugated strip includes a leading edge and a trailing edge, said edges extending transverse to a longitudinal line extending from said inlet to said outlet.

5. The muffler of claim 1, wherein said center rectifier section includes a plate centrally positioned within said housing in said center rectfier section.

6. The muffler of claim 5, wherein said plate has two lateral edges and a plurality of fingers integrally formed along the lateral edges of the plate for maintaining the plate in proper position.

7. The muffler of claim 6, wherein said fingers are alternately bent in opposed directions to spring bias said plate in position, said plate further including a plurality of small holes to increase the boundary layer surface area.

8. The muffler of claim 1, wherein said housing comprises a pair of mating complementary members secured to one another at their peripheral edges.

9. The muffler of claim 8, wherein said inlet and said outlet have a circular cross-sectional shape.

10. The muffler of claim 8, wherein said center rectifier section includes a corrugated strip having a leading edge and a trailing edge, said edges extending transverse to a longitudinal line extending from said inlet to said outlet.

11. The muffler of claim 8, wherein said center rectifier section includes a plate centrally positioned within said housing in said center rectifier section.

12. The muffler of claim 11, wherein said plate has two lateral edges and a plurality of integrally fingers formed along the lateral edges of the plate for maintaining the plate in proper position.

13. The muffler of claim 12, wherein said fingers are alternately bent in opposed directions to spring bias said plate in position, said plate further including a plurality of small holes to increase the boundary layers surface area.

* * * * *